US007698144B2

(12) United States Patent
Parent et al.

(10) Patent No.: US 7,698,144 B2
(45) Date of Patent: Apr. 13, 2010

(54) AUTOMATED AUDIO SUB-BAND COMPARISON

(75) Inventors: Gershon Parent, Seattle, WA (US); Karen Elaine Stevens, Redmond, WA (US); Shanon Isaac Drone, Bothell, WA (US)

(73) Assignee: Microsoft Corporation, Redmond, WA (US)

( * ) Notice: Subject to any disclaimer, the term of this patent is extended or adjusted under 35 U.S.C. 154(b) by 1108 days.

(21) Appl. No.: 11/329,429

(22) Filed: Jan. 11, 2006

(65) Prior Publication Data

US 2007/0162285 A1 Jul. 12, 2007

(51) Int. Cl.
*G10L 19/00* (2006.01)
*G10L 21/00* (2006.01)

(52) U.S. Cl. ..... 704/500; 704/501

(58) Field of Classification Search ..... None
See application file for complete search history.

(56) References Cited

U.S. PATENT DOCUMENTS 5,880,392 A * 3/1999 Wessel et al. ..... 84/659
6,417,435 B2 7/2002 Chantzis et al. ..... 84/477

FOREIGN PATENT DOCUMENTS

KR 10/1997/0048564 7/1997
WO WO 2004/051202 A2 6/2004
WO WO 2006049353 A1 * 5/2006

OTHER PUBLICATIONS

Li et al, "Content-based Indexing and Retrieval of Audio Data using Wavelets", IEEE International Conference on Multimedia and Expo (II), 2000.*

* cited by examiner

*Primary Examiner*—David R Hudspeth
*Assistant Examiner*—Samuel G Neway
(74) *Attorney, Agent, or Firm*—Woodcock Washburn LLP

(57) ABSTRACT

Automated testing of audio performance of applications across platforms is provided for via capture of audio data. The audio data can include, inter alia, output sounds from a sound card or pre-rendered buffer data. The audio data is processed to produce descriptive data including data describing the audio data at least a first resolution and a second resolution. This descriptive data is used to compare data samples and describe the degree of similarity of two or more data samples. This comparison enables a determination as to whether the audio performance is satisfactory.

20 Claims, 3 Drawing Sheets

AUTOMATED AUDIO SUB-BAND COMPARISON

BACKGROUND

Software is often developed to run with a wide variety of hardware and system software. The differences between these systems have the potential to create compatibility issues. Testing for these issues is essential to ensure overall system integrity and avoid user complaints.

Human testers may be used to catch compatibility issues. This involves running the software on different system configurations and manually checking the results. Not only is this a tedious, time-consuming, and resource intensive process, but the results may be marred from subjectivity and human error.

Test automation has already proven to reduce the cost and improve the accuracy of graphics testing. For example, automated tools may be used to perform screen captures and image comparisons of the same graphical data rendered on multiple platforms. This allows the tester to quickly determine the correctness of different outputs using a standard method of measurement.

While crude automated audio testing methods exist, these methods do no more than determine the mere existence of audio output. Human testing is still needed to determine if audio output processed correctly. While human ears are relatively well-equipped to catch certain audio defects, such as popping sounds, they are inadequate for other aspects, such as precise tone/pitch differentiation, slight timing differences, or accurately parsing a complex clamor of sounds. Additionally, as previously mentioned, such human testing is tedious, time-consuming and resource-intensive and prone to errors due to subjectivity and human error.

Thus, improved audio test automation techniques are needed in order to not only determine if audio output was generated, but to also evaluate if it was generated correctly. Such techniques would improve test result quality, and reduce human testing resource costs.

SUMMARY

Application audio quality is determined through the analysis of output data. The application under test is run on a variety of systems in one embodiment of the invention, and audio output is collected from each run. In alternate embodiments, multiple samples are collected from the same system, potentially using different sound rendering techniques. The collected output may be in a variety of formats, and may contain information both from pre- and post-hardware processing.

In some embodiments, a collected sample is compared to other collected samples which may be assumed to be an ideal case. Alternately, in some embodiments, the collected sample is compared to an invention-rendered version of an ideal case. In order to perform the comparison, the collected audio samples are normalized for format, then are broken down into sub-bands. Wavelets may be used for this break-down process. Lower sub-bands are often useful for determining overall likeness of two sounds, while higher sub-bands are often useful for time resolution. When performing the comparison, in some embodiments, the sub-bands are weighted by relative test importance. The weighting scheme may vary from sample to sample.

Only some embodiments of the invention have been described in this summary. Other embodiments, advantages and novel features of the invention may become apparent from the following detailed description of the invention when considered in conjunction with included drawings.

BRIEF DESCRIPTION OF THE DRAWINGS

The foregoing summary, as well as the following detailed description of preferred embodiments, is better understood when read in conjunction with the appended drawings. For the purpose of illustrating the invention, the drawings show exemplary constructions of the invention; however, the invention is not limited to the specific methods and instrumentalities disclosed. In the drawings.

DETAILED DESCRIPTION

Exemplary Computing Environment

Figure 1:
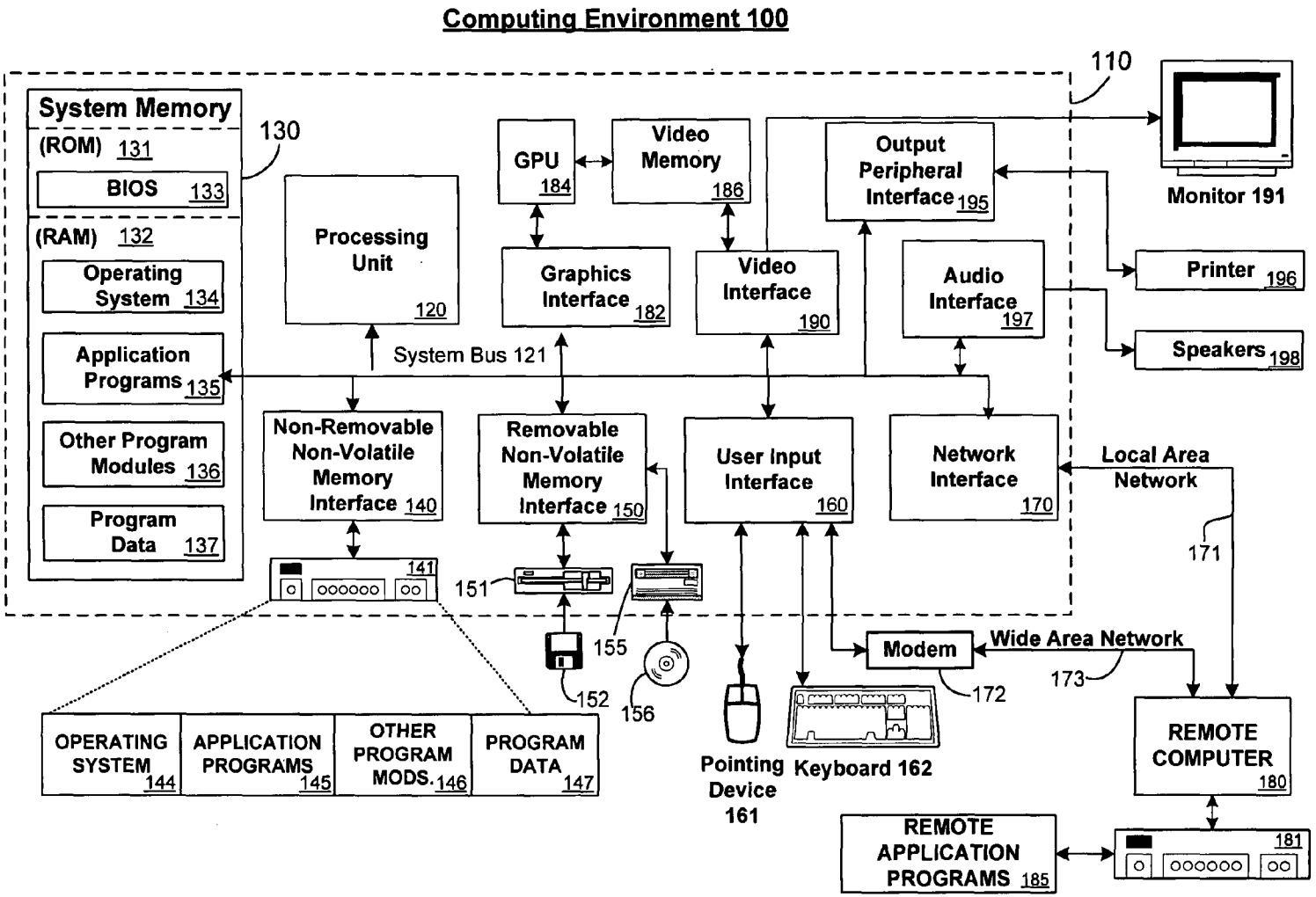
FIG. 1 is a block diagram of an exemplary computing environment in which aspects of the invention may be implemented.

FIG. 1 shows an exemplary computing environment in which aspects of the invention may be implemented. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary computing environment 100.

The invention is operational with numerous other general purpose or special purpose computing system environments or configurations. Examples of well known computing systems, environments, and/or configurations that may be suitable for use with the invention include, but are not limited to, personal computers, server computers, hand-held or laptop devices, multiprocessor systems, microprocessor-based systems, set top boxes, programmable consumer electronics, network PCs, minicomputers, mainframe computers, embedded systems, distributed computing environments that include any of the above systems or devices, and the like.

The invention may be described in the general context of computer-executable instructions, such as program modules, being executed by a computer. Generally, program modules include routines, programs, objects, components, data structures, etc. that perform particular tasks or implement particular abstract data types. The invention may also be practiced in distributed computing environments where tasks are performed by remote processing devices that are linked through a communications network or other data transmission medium. In a distributed computing environment, program modules and other data may be located in both local and remote computer storage media including memory storage devices.

With reference to FIG. 1, an exemplary system for implementing the invention includes a general purpose computing device in the form of a computer 110. Components of computer 110 may include, but are not limited to, a processing unit 120, a system memory 130, and a system bus 121 that couples various system components including the system memory to the processing unit 120. The processing unit 120 may represent multiple logical processing units such as those supported on a multi-threaded processor. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus (also known as Mezzanine bus). The system bus 121 may also be implemented as a point-to-point connection, switching fabric, or the like, among the communicating devices.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CDROM, digital versatile disks (DVD) or other optical disk storage, magnetic cassettes, magnetic tape, magnetic disk storage or other magnetic storage devices, or any other medium which can be used to store the desired information and which can accessed by computer 110. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable, volatile/nonvolatile computer storage media. By way of example only, FIG. 1 illustrates a hard disk drive 140 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156, such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies. A user may enter commands and information into the computer 20 through input devices such as a keyboard 162 and pointing device 161, commonly referred to as a mouse, trackball or touch pad. Other input devices (not shown) may include a microphone, joystick, game pad, satellite dish, scanner, or the like. These and other input devices are often connected to the processing unit 120 through a user input interface 160 that is coupled to the system bus, but may be connected by other interface and bus structures, such as a parallel port, game port or a universal serial bus (USB). The system may contain one or more audio interfaces 197, which may be connected to one or more speakers 198. An audio interface may include a feedback loop to return data back to the system. A monitor 191 or other type of display device is also connected to the system bus 121 via an interface, such as a video interface 190. In addition to the monitor, computers may also include other peripheral output devices such as a printer 196, which may be connected through an output peripheral interface 195.

The computer 110 may operate in a networked environment using logical connections to one or more remote computers, such as a remote computer 180. The remote computer 180 may be a personal computer, a server, a router, a network PC, a peer device or other common network node, and typically includes many or all of the elements described above relative to the computer 110, although only a memory storage device 181 has been illustrated in FIG. 1. The logical connections depicted in FIG. 1 include a local area network (LAN) 171 and a wide area network (WAN) 173, but may also include other networks. Such networking environments are commonplace in offices, enterprise-wide computer networks, intranets and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on memory device 181. It will be appreciated that the network connections shown are exemplary and other means of establishing a communications link between the computers may be used.

Automated Comparison of Audio Output

Figure 2:
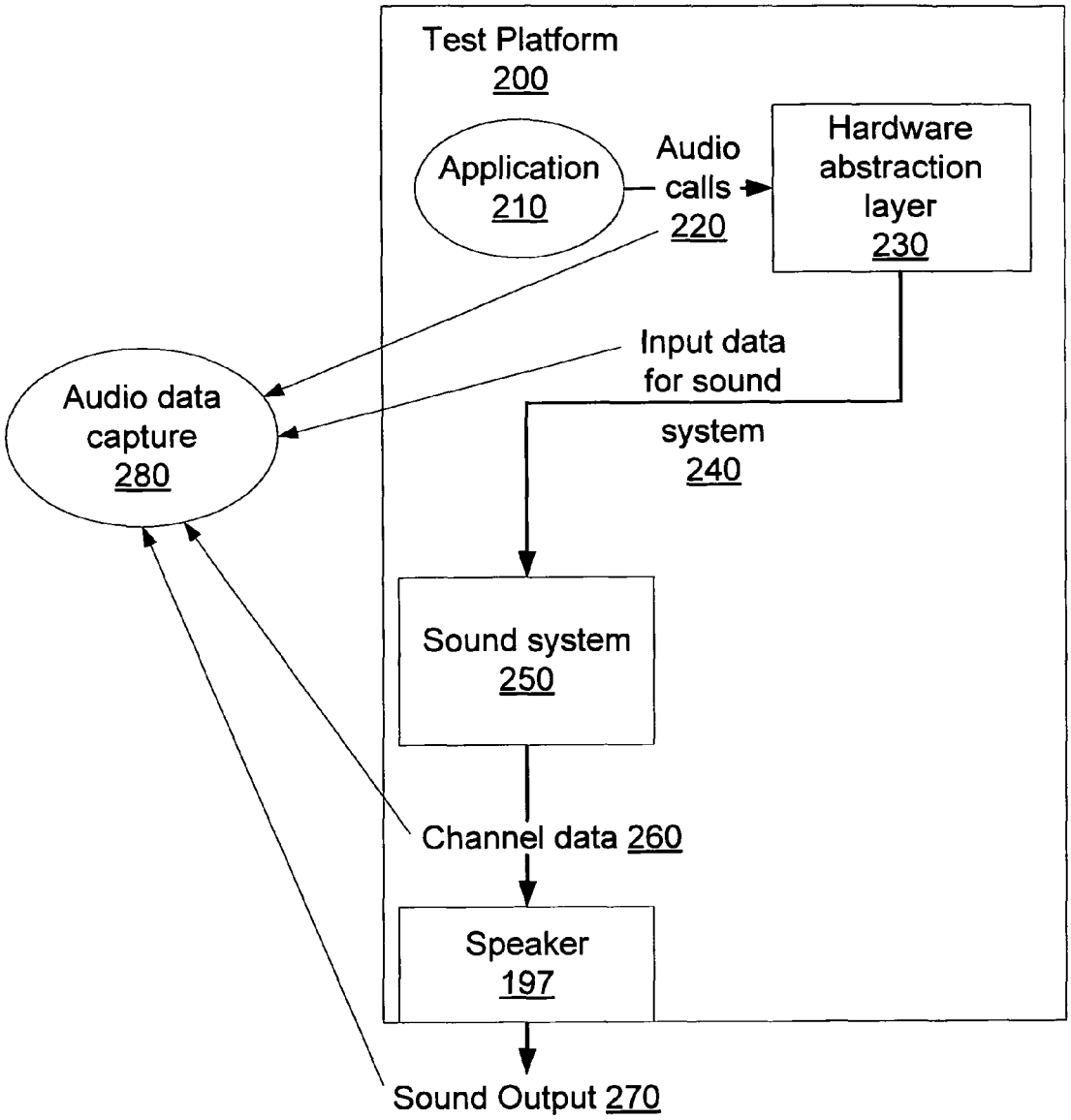
FIG. 2 is a block diagram of the collection of audio data from a test platform according to one embodiment of the invention.

FIG. 2 is a block diagram of the collection of audio data from a test platform. As shown in FIG. 2, an application 210 to be tested is run on a test platform 200. The application generates sound output 270 via sound system 250. As shown and discussed with reference to FIG. 1, speakers 198 may be used in order to produce sound output 270. In some platforms, a sound card may be part of the sound system 250; the sound card including memory and processing functionality. The sound system 250 outputs channel data 260. This channel data is generally analog audio (waveform) data. The channel data 260 includes data for one or more channels; each channel has separate analog audio data for that channel.

As mentioned, there may be data for one channel in channel data 260, or there may be data for more than one channel. For example, if a monaural output is being output, only a single channel would be included in channel data 260. If stereo output is being output, two channels would be included in channel data 260. More channels may be provided, for example, for surround sound. The channel data 260 is made available to speakers 198, which use the channel data 260 in producing sound output 270.

Additionally, as shown in FIG. 2, an application 210 makes use of a hardware abstraction layer 230. The hardware abstraction layer 230 allows the application 210 to delegate some of the tasks involved in producing the sound output 270 on the test platform. For example, a hardware abstraction layer 230 may provide application programming interfaces (APIs) which can be used by the application 210 rather than requiring the application to manage the sound system 250 or the speaker 198 directly. The audio calls 220 to the hardware abstraction layer 230 are used instead in order to guide the production of the sound output 270. The hardware abstraction layer 230 uses the audio calls 220 to produce input data 240 for the sound system 250.

While FIG. 2 shows a test platform 200 with a hardware abstraction layer, 230, a sound system 250, and a speaker 198, a test platform may include all, some, or none of these, for at least two reasons. First, some or all of these items may not be used by the application 210 in the production of sound output 270 in the normal course of operation of a platform. For example, an application may directly control the speaker, in which case, channel data 260 will be produced directly from the application 210. Secondly, a test platform may not include all the elements which would normally be used in producing sound output 270 per an application 210. As will be described, audio data capture 280 captures audio data from one or more points in between the application 210 and the ultimate sound output 270. In one example, the audio data capture 280 captures audio calls 220 to a hardware abstraction layer 230, and not input data 240 for the sound system 250 or any other audio data. In such a case, in a test platform, no sound system 250 or speaker 198 need be actually present, as long as the absence of such elements does not interfere with the execution of application 210 on test data.

More generally, while a specific flow of audio data from the application 210 is shown in FIG. 2 and described, the invention may be practiced no matter what the exact flow of audio data, including intermediate elements receiving and emitting audio data.

The audio data capture 280 captures audio data at any point in the flow of audio data from the application 210 to the sound output 280. Thus, as shown, the audio data capture 280 may capture audio calls 220, input data 240 for sound system, channel data 260, and/or sound output 280. Additionally, where other flows of audio data occur between an application 210 and the ultimate output of sound, any of the audio data may be captured by the audio data capture 280.

The audio data capture 280 may be performed via modifications to the intermediate elements. For example, the hardware abstraction layer 230 may be modified to perform the normal functions of the hardware abstraction layer 230 and to capture audio calls 220 and/or input data 240 for the sound system 250. Alternatively or in addition, the audio data capture 280 may be performed by monitoring traffic between the elements in any way. The audio data capture 280 of sound output 270 may be performed by means of a feedback loop.

Figure 3:
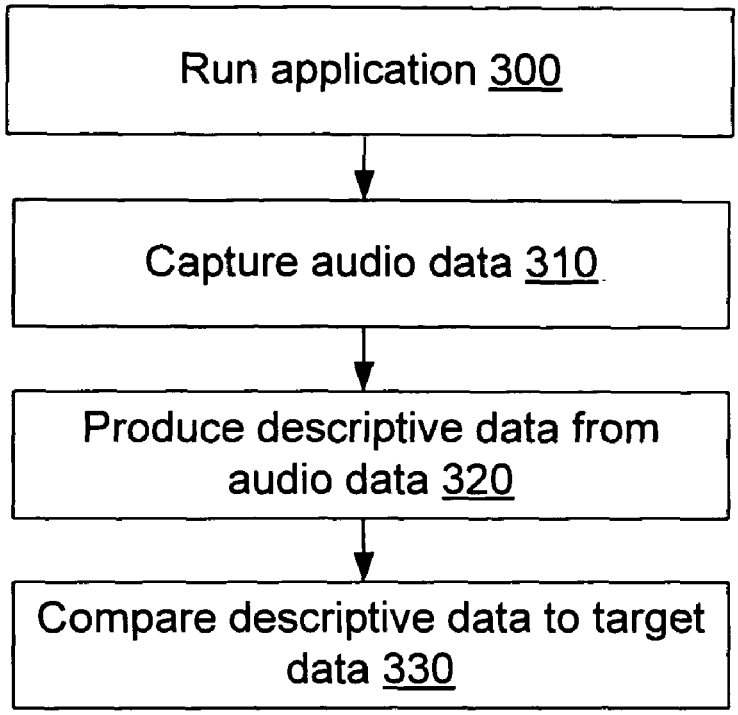
FIG. 3 is a flow diagram detailing this process according to one embodiment of the invention.

Once the audio data capture 280 has captured audio data, comparison of the captured audio data can be performed with target data. FIG. 3 is a flow diagram detailing this process according to one embodiment of the invention. As seen in FIG. 3, in a first step 300, the application to be tested in run on a test platform. In one embodiment, application 210 is run with a specific set of testing inputs. Audio data from the running of the application is captured, in step 310. As detailed above, this audio data may be found at any stage of the application.

Producing Descriptive Data

In a second step, 320, the descriptive data is produced which describes the audio data. The descriptive data describes each audio channel ultimately to be produced by the audio data (in whatever form that audio data is found in) in a form which allows a comparison to be made.

One way in which to produce descriptive data is using wavelets. Using wavelets, for example, a discrete wavelet transform (DWT), on the captured audio data. The captured audio data, if it is not in a form which describes an audio signal, is first converted to a form in which it describes an audio signal. Thus, if, for example, the captured audio data consists of audio calls 220 to a hardware abstraction layer 230, the captured audio data is converted to a form in which it describes an audio signal, such as in the form of a channel of channel data similar to (or equivalent to) channel data 260 or in the form of actually recorded sound data such as sound output 270.

When the captured audio data is in audio signal (waveform) form, the following steps are performed according to one embodiment of the invention in which DWT is used. The end result is the production of sub-bands from the captured audio data. These steps are performed on each audio channel which will be the subject of a comparison. First, a high-pass and low-pass filter used are run over the audio signal data. These filters are derived from the wavelet on which the transform is based. The data is split by the filters into two equal parts, the high-pass part and the low-pass part. This process continues recursively, with each low-pass part being run through the high-pass and low-pass filters until only one low pass sample remains. The effectively splits the audio signal data into $\log_2(n)$ sub-bands of coefficients, where n is the number of samples in the audio data. (Note that, n must be a power of 2. In some embodiments, if the number of samples in the audio data is not a power of 2, addition of dummy data to the audio data occurs to create the correct number of samples. In some embodiments, the dummy data is zero data.)

Each increasing sub-band contains twice as many coefficients as the previous sub-band. The highest frequency sub-band contains n/2 samples, where n is the number of original samples in the waveform. If desired, the original waveform (audio signal data) can be exactly reconstructed from these $\log_2(n)$ sub-bands of coefficients.

The result of the DWT is a lowest sub-band which corresponds to the coefficient of the wavelet that would best fit the original waveform if only one wavelet were used to reconstruct the entire waveform. The second lowest sub-band corresponds to the two coefficients of the two wavelets that, when added to the first wavelet, would best fit the original waveform. Any and all subsequent sub-bands can be though of as holding the coefficients of the wavelets that, if added to the results reconstruction of the previous sub-bands, can be used to reconstruct the original waveform. Thus, in order to reconstruct the original waveform using the fourth sub-band, a reconstruction of the waveform using the first, second and third sub-bands is performed, then the wavelets constructed from the fourth sub-band is added. The coefficients for each sub-band N is thus a way of describing the difference between the reconstruct of the waveform using sub-bands one through N-1, and the reconstruction of the waveform using sub-bands one through N.

Before comparison, sub-bands may need to be importance filtered. This effectively removes any coefficients from the sub-bands that are below a certain threshold value, and thus do not contribute as much to the overall sound as values above the threshold. According to some embodiments, importance filtering is performed by: (1) performing a DWT on the audio sample; (2) setting any coefficients below the specified threshold value t to 0; (3) reconstructing the waveform from the DWT coefficients.

Thus, using DWT, at least two sub-bands are created. These sub-bands describe the data in the audio data in at least first descriptive data (a first sub-band) at one resolution, and second descriptive data (the second sub-band) at a second resolution.

While the DWT is shown here as the method for producing data describing the audio data at least two resolutions, there are other ways of producing data at different resolutions. For example there are variations of the DWT such as Packetized Discrete Wavelet Transforms. Additionally, different base wavelets can be used for DWT. In addition, Fast Fourier Transforms (FFTs) can be used to separate data into different frequencies where lower frequencies can be seen as a lower resolution description of the sound and higher frequencies can be seen as a higher resolution description of the sound.

Comparing Descriptive Data to Target Data

The final step according to one embodiment of the invention, as shown in FIG. 3, is the comparison of the descriptive data with target data, step 330. In order to perform a comparison, data must be similar. Thus, the target data can be, in various embodiments, audio data in the form of a waveform, audio data from which a waveform can be derived, or description data (e.g. sub-band data) describing a waveform. However, if the target data is not in the form of description data in the same form as the descriptive data, one or more intermediate steps must be performed in order to produce target descriptive data describing the target data at least two resolutions, in a manner similar to that used to produce the descriptive data for the audio data from the test platform.

The target data, in one embodiment, is data which the application 210 should produce in the testing situation. For example, where an application has been verified (e.g. by a human tester) on a specific platform, testing data can be extracted from the performance on that platform. In an alternate embodiment, a group of platforms all run the application 210, and audio data is collected from each platform. Some averaging method is then performed on the audio data. This provides an average audio output. The average audio output is then used as target data, in order to determine the performance of each individual platform in the group (or the performance of another platform). In the case where an individual platform in the group is being tested against the average audio output, the audio data from the test platform is included to some measure in the testing data (the average audio output) to which the test platform is compared.

In some embodiments, the similarity between the descriptive data and the target data at each resolution is determined. In some embodiments, a comparison score is established based on the similarity at each resolution. Different resolutions may be differently weighted in determining the comparison score. In some embodiments, a passing threshold is established, and if the comparison score exceeds the passing threshold for similarity, the application 210 is found to have acceptable audio performance.

In one embodiment, the comparison results in a number between zero and one which describes how alike the target waveform and the audio data waveform are. A tolerance is specified by the user. This tolerance is the maximum percentage delta between two coefficients that will result in a pass. For each coefficient in a sub-band from the audio data, the coefficient is compared to the corresponding coefficient in the same sub-band of the target data. If the percentage difference is below the tolerance t, the coefficient is marked as passing. The number of passing coefficients over the number of total coefficients for that sub-band constitutes the total conformance of that sub-band. Thus, for example, a fourth sub-band according to DWT as described above contains sixteen coefficients. Each coefficient from the fourth sub-band of the descriptive data (derived from the audio data) is compared to the corresponding coefficient from the fourth sub-band derived from the target waveform. Out of those 16 pairs of coefficients, if 12 are passing (with a difference below the tolerance t), and 4 are failing (with a difference above the tolerance t) a conformance rate of 75% is calculated. Once the conformance percentages for each sub-band are calculated, they are weighted and combined together to form one conformance rate for the whole sample.

In order to determine weighting, two assumptions may be used. Generally, the higher frequency sub-bands are mostly high frequency noise and don't contribute significantly to the overall waveform. This assumes that the waveform hasn't been importance filtered to remove this noise. If filtering has occurred, the higher frequency sub-bands may all have coefficients of 0. Generally, the low frequency sub-bands are very crude shapes of the approximate waveform and don't take into account the mid-ranged subtleties of the sound. Thus, according to one embodiment, the weights are assigned to the sub-band conformance rates based upon a Gaussian distribution centered around the log2(n)/2 sub-band. The result of this weighting is a conformance value that shifts importance to the lower sub-bands, and therefore, gives more weight to the more general wave shape rather than subtleties of the sound.

However, it should be noted that in some cases, these assumptions do not hold. Because of this, and in order to compare different aspects of the sound, a different weighting scheme should be used.

In order to compare two audio samples together, they must be synchronized to start at the exact same point. According to some embodiments, synchronization is achieved by importance filtering both the audio data and the target data using a very large value, and reconstructing the waveforms from the importance filtered data and searching for the first non-zero value. This is assumed to be the same position in both the audio data and target data, and this position is used to synchronize the audio data with the target data for the comparison.

Figure 4:
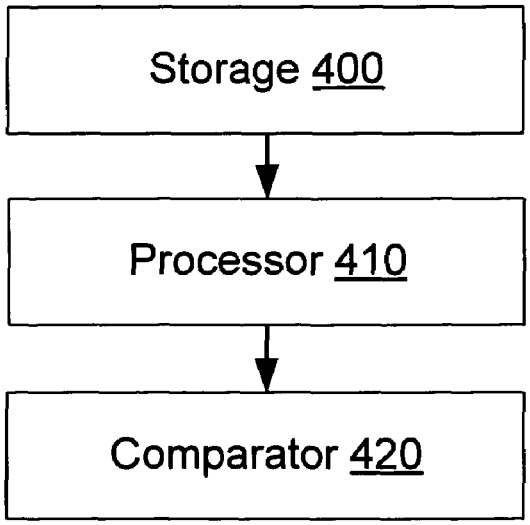
FIG. 4 is a block diagram of a system according to one embodiment of the invention.

FIG. 4 is a block diagram of a system according to one embodiment of the invention. As shown in FIG. 4, a system according to one embodiment of the invention includes storage 400 for storing audio data from the test platform. A processor 410 is used to transform the audio data into descriptive data. As described above, in one embodiment, this descriptive data includes sub-band data from a DWT which describes the data at different resolutions. A comparator 420 is used to compare the descriptive data to target descriptive data.

CONCLUSION

It is noted that the foregoing examples have been provided merely for the purpose of explanation and are in no way to be construed as limiting of the present invention. While the invention has been described with reference to various embodiments, it is understood that the words which have been used herein are words of description and illustration, rather than words of limitations. Further, although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

What is claimed:

1. A method for testing audio performance of an application on a test platform, comprising:

running said application on said test platform;

capturing audio data from said running of said application on said test platform;

calculating first descriptive data using said audio data, said first descriptive data comprising data describing said audio data using at least a first resolution and a second resolution;

synchronizing said first descriptive data and target data by:

importance filtering the first descriptive data and the target data to obtain importance filtered data;

reconstructing waveforms from the importance filtered data;

searching the reconstructed waveforms for a first non-zero value; and assuming the first non-zero value is in a same position in the first descriptive data and the target data; and following their synchronization, comparing said first descriptive data to said target data.

2. The method of claim 1, where said step of running said application on said test platform comprises providing pre-specified testing inputs to said application running on said test platform.

3. The method of claim 1, where said step of calculating said first descriptive data comprises:

calculating a set of at least two sub-bands, each of said sub-bands describing said audio data.

4. The method of claim 3, where a first sub-band from among said set describes said audio data at said first resolution and a second sub-band from among said set describes said audio data at said second resolution.

5. The method of claim 3, where said sub-bands are calculated using a discrete wavelet transform.

6. The method of claim 1, where said step of comparing said first descriptive data to said target data comprises:

calculating at least two intermediate comparison values, each of said intermediate comparison values indicating a likeness of said audio data and said target data at a specific resolution; and calculating a final comparison value, said final comparison value based on said intermediate comparison values.

7. The method of claim 6, where said step of calculating a final comparison value comprises weighting at least a first one of said intermediate comparison values differently from at least a second one of said intermediate comparison values.

8. The method of claim 1, where audio data comprises buffered sound data as created by said application for presentation via a sound system.

9. A system for audio performance testing of an application, comprising:

a storage for storing audio data, said audio data resulting from the running of an application on a test platform;

a processor for calculating descriptive data regarding characteristics of said audio data, said descriptive data comprising data describing said audio data using at least a first resolution and a second resolution, said processor operably connected to said storage; and a comparator for comparing synchronized descriptive data and target descriptive data, wherein the descriptive data and the target descriptive data are synchronized by:

importance filtering the descriptive data and the target descriptive data to obtain importance filtered data;

reconstructing waveforms from the importance filtered data;

searching the reconstructed waveforms for a first non-zero value; and assuming the first non-zero value is in a same position in the descriptive data and the target descriptive data; and said comparator operably connected to said processor and wherein said target descriptive data is calculated from target data comprising an average of data resulting from running said application on a plurality of platforms or from running said application on one platform using a plurality of different sound rendering techniques.

10. The method of claim 9, where said processor calculates a set of at least two sub-bands, each of said sub-bands describing said audio data.

11. The system of claim 10, where a first sub-band from among said set describes said audio data at said first resolution and a second sub-band from among said set describes said audio data at said second resolution.

12. The system of claim 10, where said sub-bands are calculated using a discrete wavelet transform.

13. The system of claim 9, where said comparator calculates at least two intermediate comparison values, each of said intermediate comparison values indicating a likeness of said audio data and said target data at a specific resolution; and calculates a final comparison value, said final comparison value based on said intermediate comparison values.

14. The system of claim 13, where in said calculation of a final comparison value, said comparator weights at least a first one of said intermediate comparison values differently from at least a second one of said intermediate comparison values.

15. The system of claim 9, where audio data comprises buffered sound data as created by said application for presentation via a sound system.

16. A computer-readable storage medium comprising computer-executable instructions for verifying sound performance by a software application, said computer-executable instructions for performing steps comprising:

capturing audio calls generated by said software application running on a test platform, said audio calls being made to a hardware abstraction layer;

converting said audio calls to audio data;

storing said audio data;

calculating from said audio data sub-band data comprising at least a first sub-band and a second sub-band audio data; and comparing synchronized sub-band data and target sub-band data, wherein the sub-band data and the target sub-band data are synchronized by:

importance filtering the sub-band data and the target sub-band data to obtain importance filtered data;

reconstructing waveforms from the importance filtered data;

searching the reconstructed waveforms for a first non-zero value; and assuming the first non-zero value is in a same position in the sub-band data and the target sub-band data.

17. The computer-readable storage medium of claim 16, where said first sub-band from among said set describes said audio data at a first resolution and said second sub-band describes said audio data at a second resolution.

18. The computer-readable storage medium of claim 16, where said sub-bands are calculated using a discrete wavelet transform.

19. The computer-readable storage medium of claim 16, where said step of comparing said sub-band data to target sub-band data comprises:

calculating at least two intermediate comparison values, each of said intermediate comparison values indicating a likeness of said sub-band data to said target sub-band data at a particular sub-band; and calculating a final comparison value, said final comparison value based on said intermediate comparison values.

20. The computer-readable storage medium of claim 16, where said step of calculating a final comparison value comprises weighting at least a first one of said intermediate comparison values differently from at least a second one of said intermediate comparison values.

* * * * *